US006520795B1

(12) United States Patent
Jazowski

(10) Patent No.: US 6,520,795 B1
(45) Date of Patent: Feb. 18, 2003

(54) LOAD REDUCING ELECTRICAL DEVICE

(75) Inventor: Roy E. Jazowski, Aiken, SC (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/920,326

(22) Filed: Aug. 2, 2001

(51) Int. Cl.[7] ..... H01R 13/58

(52) U.S. Cl. ..... 439/475; 439/801; 439/921; 439/813

(58) Field of Search ..... 439/801, 921, 439/813, 475

(56) References Cited

U.S. PATENT DOCUMENTS

| | | | | |
|---|---|---|---|---|
| 2,599,026 | A | | 6/1952 | Strayer |
| 3,136,040 | A | | 6/1964 | Bauer et al. |
| 3,861,777 | A | | 1/1975 | Clark |
| 3,883,208 | A | | 5/1975 | Sankey et al. |
| 3,924,919 | A | | 12/1975 | McClain |
| 3,959,869 | A | | 6/1976 | Wyman et al. |
| 3,982,812 | A | | 9/1976 | Boliver |
| 4,202,591 | A | | 5/1980 | Borgstrom |
| 4,353,611 | A | | 10/1982 | Siebens et al. |
| 4,354,721 | A | | 10/1982 | Luzzi |
| 4,360,967 | A | | 11/1982 | Luzzi et al. |
| 4,420,202 | A | | 12/1983 | Atakkaan |
| 4,715,104 | A | | 12/1987 | Schoenwetter et al. |
| 4,722,694 | A | | 2/1988 | Makal et al. |
| 4,773,872 | A | | 9/1988 | Borgstrom et al. |
| 4,776,089 | A | | 10/1988 | Schoenwetter et al. |
| 4,779,341 | A | | 10/1988 | Roscizewski |
| 4,787,855 | A | | 11/1988 | Finke |
| 4,799,895 | A | | 1/1989 | Borgstrom |
| 4,857,021 | A | | 8/1989 | Boliver et al. |
| 4,865,559 | A | | 9/1989 | Clabburn |
| 4,891,016 | A | | 1/1990 | Luzzi et al. |
| 4,946,394 | A | | 8/1990 | Knapp et al. |
| 4,955,823 | A | | 9/1990 | Luzzi |
| 5,041,004 | A | * | 8/1991 | Waldorf ..... 439/801 |
| 5,230,142 | A | | 7/1993 | Roscizewski |
| 5,421,750 | A | | 6/1995 | Crotty |
| 5,427,538 | A | | 6/1995 | Knapp et al. |
| 6,042,407 | A | | 3/2000 | Scull et al. |

FOREIGN PATENT DOCUMENTS

| | | |
|---|---|---|
| EP | 0211741 | 7/1988 |

* cited by examiner

*Primary Examiner*—Tho D. Ta
(74) *Attorney, Agent, or Firm*—Alfred N. Goodman; Mark S. Bicks; Tara L. Hoffman

(57) ABSTRACT

An electrical device, includes a housing having an inner bore with a longitudinal axis, and outer and inner engagement members. The outer engagement member is received in the inner bore of the housing, and is rotatable with respect to the housing about the longitudinal axis. The inner engagement member is rotatably supported within the outer engagement member, and has external threads for engaging an electrical interface of a piece of electrical equipment.

26 Claims, 3 Drawing Sheets

LOAD REDUCING ELECTRICAL DEVICE

FIELD OF THE INVENTION

The present invention generally relates to a load reducing electrical device. More specifically, the invention relates to a load reducing electrical device used in power distribution systems for safely connecting and disconnection high voltage cables.

BACKGROUND OF THE INVENTION

Power distribution systems often require a lineman to connect and disconnect high voltage cables from system electrical equipment. Separable connectors and devices are used to connect and disconnect the cables to the electrical equipment. Typically, a section of the system is de-energized prior to a lineman performing any work on that section. However, because a lineman does not have visual indication that the system is de-energized, the lineman risks injury if there is current remaining in the system.

Conventional separable connectors and devices, such as tap plugs, provide a mechanism for isolating the high voltage cable to protect the lineman from injury. Typically, the conventional tap plug is electrically connected to both the cable and the electrical equipment by connecting the tap plug to a cable connector and a bushing of the system electrical equipment. Also, as a protective measure a grounding elbow is also attached to the tap plug before disconnecting the cable from the electrical equipment. However, conventional tap plugs are often cumbersome to connect to the cable connector and bushing.

Examples of conventional tap plugs are U.S. Pat. No. 3,959,869 to Wyman et al.; U.S. Pat. No. 3,982,812 to Boliver; U.S. Pat. No. 4,202,591 to Borgstrom; U.S. Pat. No. 4,354,721 to Luzzi; U.S. Pat. No. 4,722,694 to Makal et al.; U.S. Pat. No. 4,779,341 to Roscizewski; U.S. Pat. No. 4,799,895 to Borgstrom; U.S. Pat. No. 4,891,016 to Luzzi et al.; U.S. Pat. No. 4,946,394 to Knapp et al.; U.S. Pat. No. 4,955,823 to Luzzi; U.S. Pat. No. 5,421,750 to Crotty; and U.S. Pat. No. 5,427,538 to Knapp et al.

SUMMARY OF THE INVENTION

Accordingly, an object of the present invention is to provide a load reducing electrical device that easily connects to both a cable connector and an electrical interface or bushing of a power distribution system.

Another object of the present invention is to provide a load reducing electrical device that allows one lineman to assemble and disassemble the electrical device from the cable connector and bushing.

Yet another object of the invention is to provide a load reducing electrical device that provides continuous grounding during connection and disconnection of a high voltage cable.

The foregoing objects are basically attained by an electrical device, comprising a housing that has an inner bore with a longitudinal axis, and first and second engagement members. The first engagement member is received in the inner bore of the housing, and the first engagement member is rotatable with respect to the housing about the longitudinal axis. The second engagement member is rotatably supported within the first engagement member, and has external threads for engaging an electrical interface of a piece of electrical equipment.

The foregoing objects are also attained by a method of electrically connecting an electrical device to an electrical interface of a piece of electrical equipment, that includes the steps of coupling the electrical device with an electrical connector by inserting the electrical device into a first port of the electrical connector and rotating a conductive first engagement member relative to an insulation housing therefor of the electrical device into an inner receiving bore of the electrical connector. The method also includes the step of coupling the electrical connector with the electrical interface by placing the electrical interface into a second port of the electrical connector. Additionally, the method includes coupling the electrical device with the electrical interface by rotating and axially moving a conductive second engagement member supported within the first engagement member of the electrical device into a receiving bore of the electrical interface.

By fashioning and using the invention in the above manner, a load reducing electrical device is provided that allows both safe and easy connection and disconnection of a high voltage cable from power system electrical equipment.

Other objects, advantages and salient features of the invention will become apparent from the following detailed description, which, taken in conjunction with annexed drawings, discloses a preferred embodiment of the present invention.

BRIEF DESCRIPTION OF THE DRAWINGS

Referring to the drawings which form a part of this disclosure.

Detailed Description of the Invention

Figure 1:
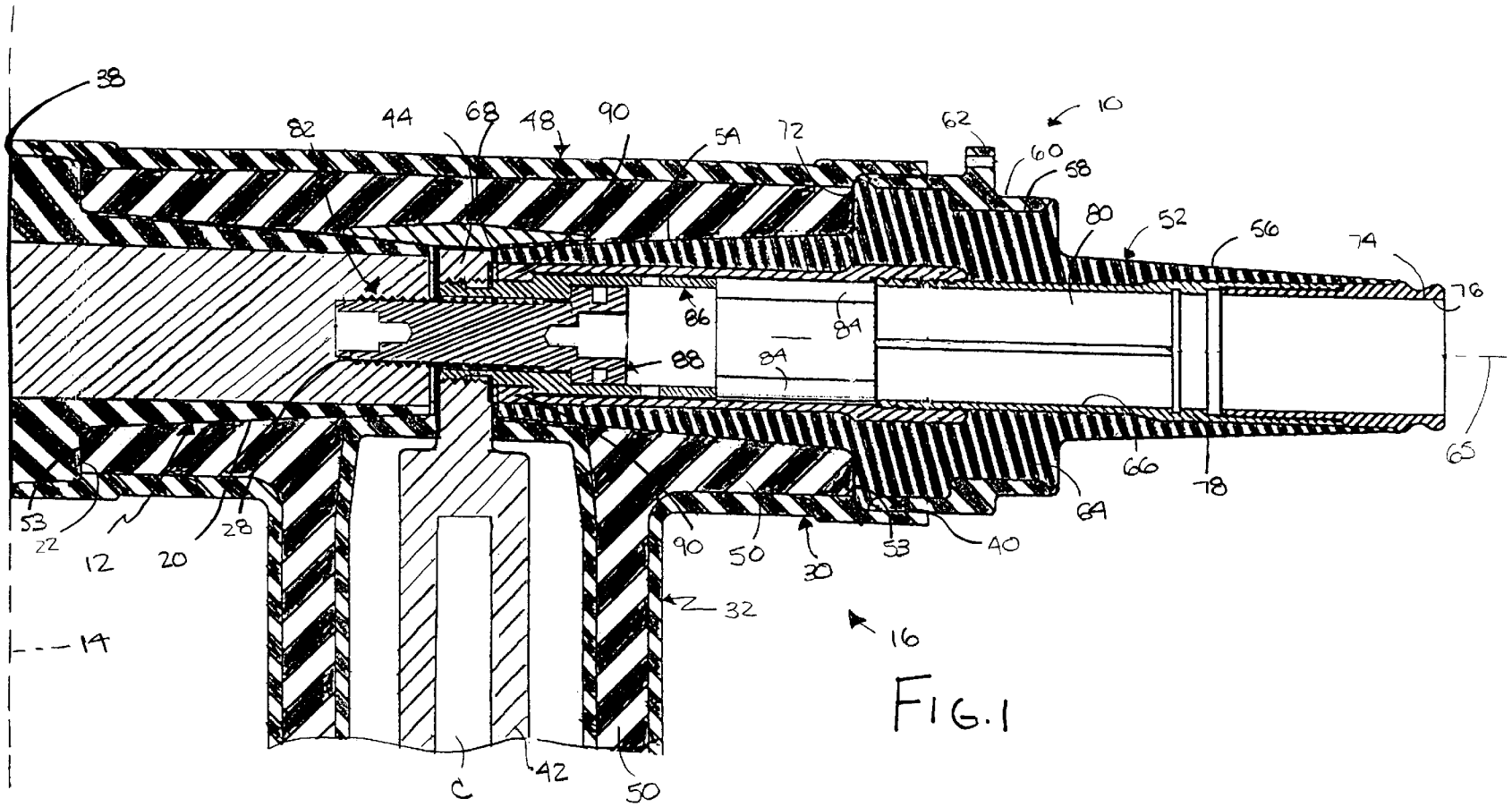
FIG. 1 is a side, sectional view of an electrical assembly in accordance with the present invention, showing an electrical device, electrical connector, and equipment interface of the present invention.

Referring to FIGS. 1–5, an electrical assembly 10 according to the present invention generally includes an electrical interface 12 of a piece of electrical equipment 14, an electrical cable connector 16, and a load reducing electrical device 18. Load reducing electrical device 18 is a safety device that provides protection to a lineman when connecting and disconnecting cable connector 16 from electrical equipment interface 12. Specifically, electrical device 18 provides a ground for the assembly 10 thereby ensuring protection in case the system cable is re-energized during connection or disconnection of cable connector 16 and electrical interface 12.

Figure 2:
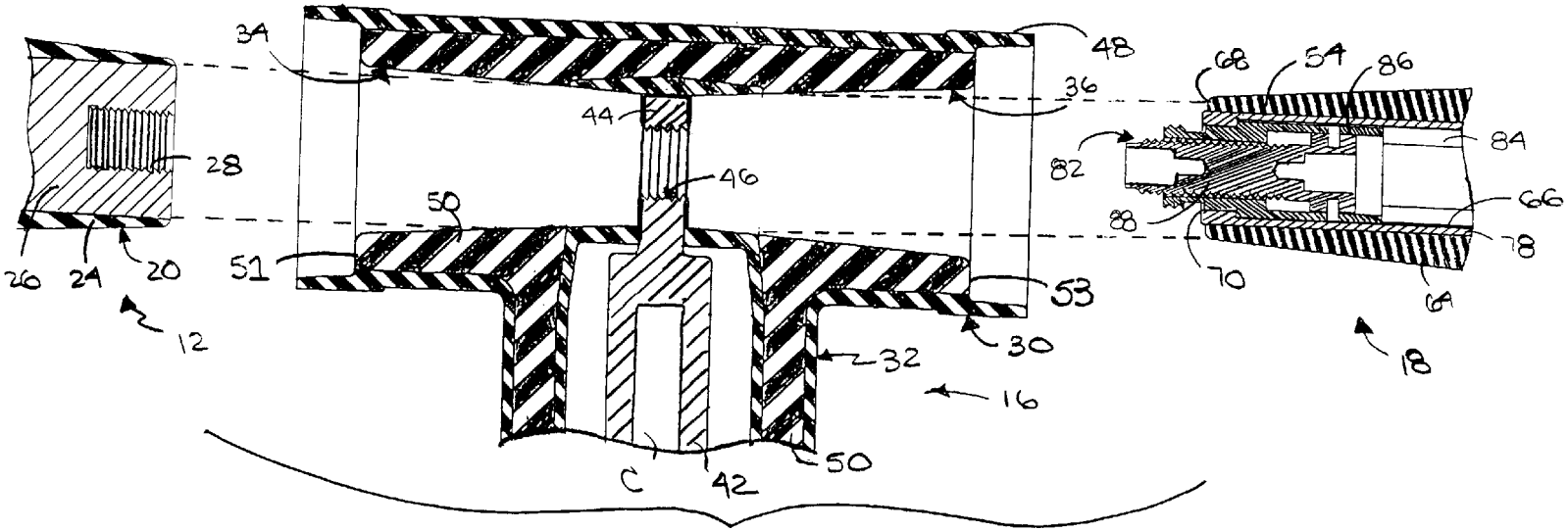
FIG. 2 is an exploded, side sectional view of the electrical assembly illustrated in FIG. 1, showing partial views of the electrical device, electrical connector, and equipment interface.
Figure 3:
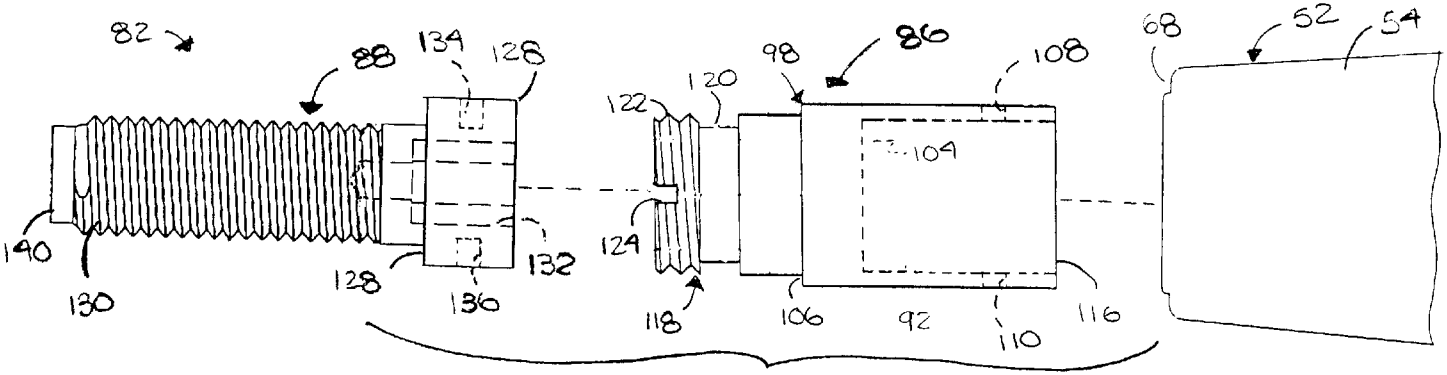
FIG. 3 is an exploded view of the electrical device and connector assembly in accordance with the present invention, showing first and second engagement members and a housing of the electrical device.

As seen in FIGS. 1–3, electrical interface 12 is preferably a 600 amp bushing attached to a piece of electrical equipment 14, such as a transformer, switch, or any other high voltage electrical equipment. Cable connector 16 is preferably a 600 amp elbow or tee connector. Bushing 12 and cable connector 16 are well known in the art and therefore will only be generally described. An example of a conventional bushing and cable connector is disclosed in commonly assigned U.S. Pat. No. 6,042,407 to Scull et al. entitled Safe-Operating Load Reducing Tap Plug and Method of Using The Same, the subject matter of which is herein incorporated by reference.

In general, bushing 12 includes an outer epoxy or rubber housing 20 having base 22 and a frusto-conical portion 24 extending from the base 22. Base 22 is connected to electrical equipment 14. Bushing 12 also includes an inner conductive core 26 with a internally threaded receiving bore 28 remote from base 22 for receiving a portion of electrical device 18.

Cable connector 16 electrically connects a cable C to electrical equipment 14 through bushing 12. Connector 16 generally includes first and second sections 30 and 32. First section 30 includes first and second ports 34 and 36 that are axially aligned and have opposite first and second access openings 38 and 40, respectively. First port 34 receives bushing 12 and second port 36 receives load reducing electrical device 18. Second section 32 extends from first section 30 forming a substantially T-shaped cable connector.

Second section 32 supports cable C electrically connected to a conductor contact 42. An end portion 44 of conductor contact 42 extends into first section 30 of connector 16 between first and second ports 34 and 36. End portion 44 includes a central inner receiving bore 46 having internal threads that correspond to a portion of electrical device 18. Also, cable connector 16 is formed with an outer semi-conductive jacket 48 and an inner insulation layer 50. Inner insulation layer 50 includes a free end 51 at first port 34, and a free end 53 at second port 36.

As seen in FIGS. 1–5, load reducing electrical device 18 includes a housing 52 with first and second frusto-conical sections 54 and 56 with a middle generally cylindrical section 58 therebetween, as is well known in the art. Middle section 58 is thicker and wider than first and second sections 54 and 56 and supports an outer semi-conductive jacket 60 that has a ground connection 62 disposed thereon. Housing 52 is formed by an outer electrically insulative layer 64 and has an inner bore 66 therein defined along the longitudinal axis 65 of the housing 52. A distal end 68 of first section 54 includes opening 70 providing access to inner bore 66. Also, an abutment shoulder 72 is defined between middle and first sections 54 and 58. Second section 56 includes a distal nose piece 74 and a second opening 76 opposite the opening 70 of first section 54.

Within inner bore 66 is a fixed conductive inner layer 78 and a female contact and piston assembly (not shown) in area 80 located in the middle and second sections 58 and 56 of housing 52, as is well known in the art. Remote from area 80 is a connector assembly 82 located in inner bore 66 at the first section 54 of housing 52 for connecting to both bushing 12 and cable connector 16. Spacers 84 are disposed between piston assembly 80 and connector assembly 82.

Connector assembly 82 includes a first engagement member 86 that corresponds to a portion of cable connector 16 and a second engagement member 88 slidably received in first engagement member 86 that corresponds to a portion of bushing 12.

Figure 4:
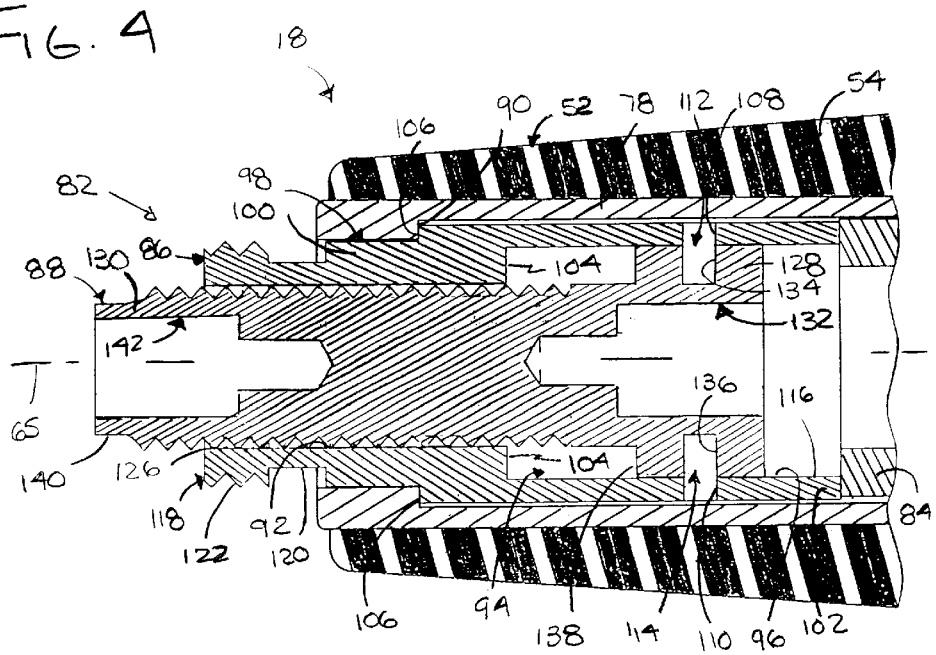
FIG. 4 is an enlarged, side, sectional, partial view of the electrical device illustrated in FIGS. 1 and 2, showing the connector assembly in a first position.
Figure 5:
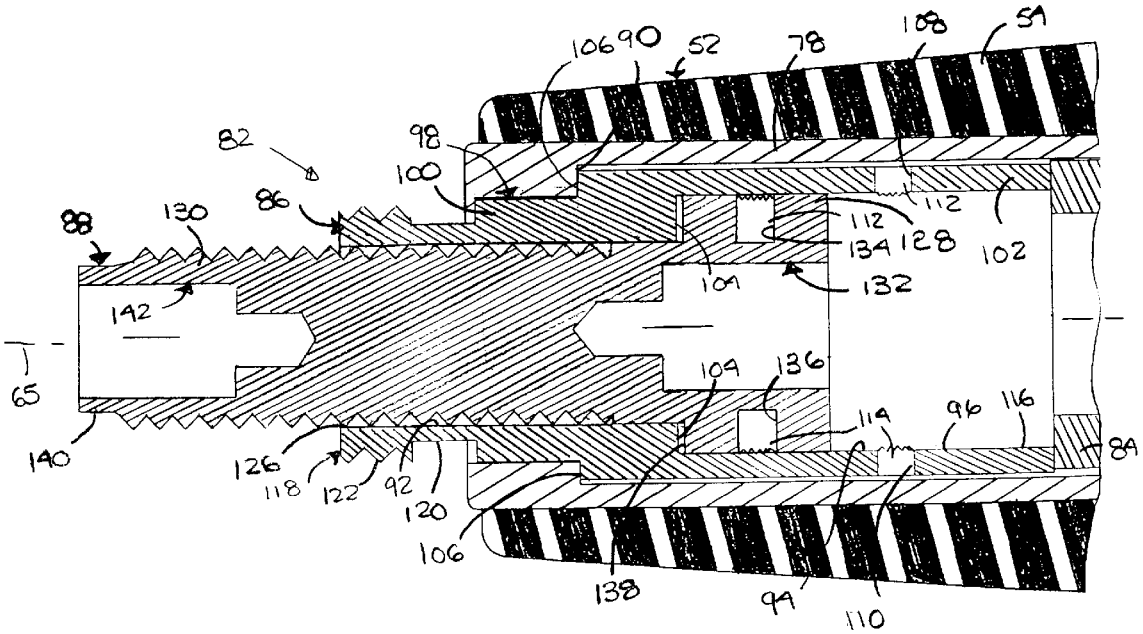
FIG. 5 is an enlarged, side, sectional, partial view of the electrical device illustrated in FIGS. 1 and 2, showing the connector assembly in a second position.

First engagement member 86 is preferably formed as a electrically conductive sleeve that rotates with respect to and about the longitudinal axis 65 of housing 52, rotates with respect to housing 52 and is axially fixed between a terminal shoulder 90 of inner conductive layer 78 and spacers 84. First engagement member 86 is hollow, thereby defining an inner surface 96 and first and second continuous receiving areas 92 and 94 with first receiving area 92 being radially smaller than second area 94, as best seen in FIGS. 4 and 5.

An inner portion 98 of first engagement member 86 is received in inner bore 66 so that inner portion 98 is adjacent to inner conductive layer 78. Inner portion 98 includes first and second sections 100 and 102 with an inner shelf 104 disposed therebetween. First section 100 of inner portion 98 includes an outer stopping shoulder 106 that abuts terminal shoulder 90 of inner conductive layer 78. Second section 102 includes diametrically opposing lateral openings 108 and 110 for receiving shear pins 112 and 114, respectively, as best seen in FIGS. 4 and 5. Also, the open end 116 of second section 102 abuts spacers 84. The abutment of first section stopping shoulder 106 and terminal shoulder 90 and the abutment of second section end 116 and spacers 84, restricts the axial movement of first engagement member.

An outer portion 118 of first engagement member 86 extends outwardly beyond distal end 54 of housing 52. Outer portion 118 includes a neck 120 and distal externally threaded end 122 for engaging cable connector inner bore 46. At least two opposing notches 124 are disposed in threaded end 122, as seen in FIG. 3 (showing one notch). An end opening 126 provides access to first and second inner areas 92 and 94.

Second engagement member 88 is received in first engagement 86 so that second engagement member 88 rotates with respect to first engagement member 86 and the longitudinal axis 65 of housing 52. Also, second engagement member 88 slides with respect to first engagement member inner surface 96 axially along the housing longitudinal axis. Second engagement member 88 is an electrically conductive member and includes a base end 128 with a bolt portion 130 extending therefrom. Base end 128 includes a tool socket 132 and diametrically opposing pin openings 134 and 136 disposed on either side of tool socket 132. Tool socket 132 receives a tool for rotating both the first and second engagement members 86 and 88. Pin openings 134 and 136 correspond and are aligned with lateral openings 108 and 110 of first engagement member 86 for supporting shear pins 112 and 114, respectively. Base end 128 also includes an outer abutting shoulder 138 for engaging first engagement member inner shelf 104.

Bolt portion 130 is externally threaded to engage bushing inner bore 28. An external end 140 of bolt portion 130 is located opposite base end 128 and can include a second socket 142. Second socket 142 merely facilitates the molding and manufacturing process and is not necessary for the operation of the present invention.

First and second engagement members 86 and 88 are each preferably formed as unitary one-piece members. However, each member 86 and 88 can be formed of separate components that are integrally attached.

Assembly and Operation

Referring to FIGS. 1–5, in general, when connecting cable C to electrical equipment 14, load reducing electrical device is first connected to cable connector 16 for use later in grounding and isolating cable C. Once these members are connected, the assembly of electrical device 18 and cable connector 16 is connected to bushing 12 forming an electrical assembly.

Specifically, to connect electrical device 18 and cable connector 16, first section 54 of electrical device 18 is inserted into second port 36 of cable connector 16 until first engagement member 86 of electrical device 18 enters inner receiving bore 46 of cable connector 16. First engagement member 86 then engages cable connector inner bore 46 by rotating, preferably in a clockwise direction, first engagement member 86 about electrical device longitudinal axis 65 until the external threads of first engagement member threaded end 122 engage the internal threads of inner bore 46. This is accomplished by inserting a tool (not shown) into electrical device socket 132 located in second engagement member 88 and rotating both the first and the second engagement members 86 and 88.

As seen in FIG. 4, shear pins 112 and 114 temporarily fix first and second engagement members 86 and 88 with respect to each other so that rotating second engagement member 88 simultaneously rotates first engagement member 86. In this position, second engagement member 88 is substantially received within the first and second inner areas 92 and 94 of first engagement member 86 with the outer abutting shoulder 138 of second engagement member base end 128 being spaced from first engagement member inner shelf 104.

Continued rotation of first and second engagement members moves the first section 54 of electrical device 18 further into the second port 36 of cable connector 16. Upon fully engaging the threads of first engagement member 86 and cable connector inner bore 46, respectively, electrical device 18 is fully engaged in cable connector 16 with shoulder 72 of electrical device housing 52 abutting the free end 53 of cable connector inner insulative layer 50, thereby forming a tight friction fit between the two members.

Once electrical device 18 and cable connector 16 are fully engaged, the assembly of electrical device 18 and cable connector 16 is connected to bushing 12. Specifically, first port 34 of cable connector 16 is inserted onto and over bushing outer housing 20. In this position the second engagement member 88 of electrical device 18 is spaced from bushing inner bore 28.

To fully connect electrical device 18 and bushing 12, rotation is applied to first and second engagement members 86 and 88 through the tool inserted into socket 132. Since first engagement member 86 is fully received in cable connector inner receiving bore 46 and electrical device shoulder 72 abuts cable connector free end, the additional rotation and torque breaks shear pins 112 and 114.

As seen in FIG. 5, once the shear pins 112 and 114 break, second engagement member 88 is released and can then move axially and rotate with respect to first engagement member 86 and about and along the longitudinal axis 65 of electrical device 18 so that member 88 rotates with respect to housing 52. Second engagement member 88 can then be rotated using the tool inserted into socket 132 until the external threads of second engagement member bolt portion 130 are fully engaged with the internal threads of bushing inner bore 28, thereby connecting bushing 12 and electrical device 18.

Since bushing 12 is stationary, as second engagement member 88 is being rotated into bushing inner bore 28, the assembly of electrical device 18 and cable connector 16 moves over bushing housing 20 until bushing 12 is fully received in cable connector first port 34 forming a tight fit. Specifically, the base 22 of bushing 12 abuts the free end 51 of inner layer 50 of cable connector first port 34, as seen in FIG. 1. Also, in this position, bolt portion 130 extends substantially axially beyond the threaded end 122 of first engagement member 86 and the outer shoulder 138 of second engagement member base end 128 abuts the inner shelf 104 of first engagement member 86. Once electrical device 18 and cable connector 16 are assembled with bushing 12, an insulation cap (not shown) is inserted into the open end 76 of electrical device 18 while the system equipment 14 is energized and operational.

When performing maintenance on the system equipment 14, the lineman must ground and isolate cable C via electrical device 18. Specifically, the insulation cap is removed and a conventional grounding elbow (not shown) is connected to electrical device 18 through open end 76, as is well known in the art. Once grounded, cable C must then be isolated from electrical equipment 14. This requires removing the grounding elbow from electrical device 18 and inserting a tool into socket 132 through the electrical device open end 76. Second engagement member 88 of electrical device 18 is then rotated, preferably in a counter-clock wise direction, using the tool inserted into socket 132. Rotation of second engagement member 88 disengages second engagement member 88 from bushing inner bore 28, thereby releasing the assembly of cable connector 16 and electrical device 18 from bushing 12. This provides a visual break and isolates cable C from electrical equipment 14, thereby protecting the lineman from injury.

Electrical device 18 can also be separated from cable connector 16, if desired. First engagement member 86 is rotated preferably in a counter-clock wise direction to disengage the threaded end 122 from cable connector inner receiving bore 46. Specifically, a tool (not shown) is inserted into notches 124 of first engagement member, allowing first engagement member 86 to be rotated with respect to the longitudinal axis 65 of electrical device 18. First section 54 of electrical device 18 can then be removed from second port 36 of cable connector 16, thereby separating electrical device 18 and cable connector 16.

While a particular embodiment has been chosen to illustrate the invention, it will be understood by those skilled in the art that various changes and modifications can be made therein without departing from the scope of the invention as defined in the appended claims.

What is claimed is:

1. An electrical device, comprising:

a housing having an inner bore with a longitudinal axis;

a first engagement member received in said inner bore of said housing, said first engagement member being rotatable with respect to said housing about said longitudinal axis; and a second engagement member rotatably supported within said first engagement member, said second engagement member having external threads for engaging an electrical interface of a piece of electrical equipment.

2. An electrical device according to claim 1, wherein said second engagement member is axially movable with respect to said first engagement member along said longitudinal axis.

3. An electrical device according to claim 2, wherein said second engagement member slidably moves between a first position with said second engagement member substantially received in said first engagement member and a second position with said second engagement member extending substantially axially beyond of said first engagement member.

4. An electrical device according to claim 1, wherein at least one shear pin extends into each of said first and second engagement members, respectively, releasably fixing said second engagement member with respect to said first engagement member for simultaneous movement thereof.

5. An electrical device according to claim 4, wherein said shear pin extends substantially perpendicular to said longitudinal axis such that breaking said shear pin allows said second engagement member to move axially with respect to said first engagement member.

6. An electrical device according to claim 1, wherein said first engagement member is an electrically conductive sleeve;

said second engagement member is an electrically conductive bolt; and said conductive sleeve receives said conductive bolt.

7. An electrical device according to claim 1, wherein said first engagement member is axially fixed with respect to said housing, and includes external threads for engaging an electrical connector.

8. An electrical device according to claim 1, wherein said second engagement member includes first and second ends;

said first end includes said external threads; and said second end includes an opening for receiving a tool that rotates said first and second engagement members.

9. An electrical device according to claim 1, wherein each of said first and second engagement members extend beyond an end of said housing along said longitudinal axis.

10. An electrical device according to claim 1, wherein each of said first and second engagement members are formed as one-piece unitary members.

11. An electrical device, comprising:

an electrically insulative housing having an inner bore extending along a longitudinal axis;

an electrically conductive first engagement member received in said inner bore of said housing, said first engagement member being rotatable with respect to said housing about said longitudinal axis; and an electrically conductive second engagement member rotatably supported within said first engagement member and axially movable with respect to said first engagement member along said longitudinal axis.

12. An electrical device according to claim 11, wherein said second engagement member includes external threads for engaging an electrical interface of a piece of electrical equipment.

13. An electrical device according to claim 11, wherein said first engagement member is axially fixed with respect to said housing, and includes external threads for engaging an electrical connector.

14. An electrical device according to claim 11, wherein at least one shear pin extends into each of said first and second engagement members, respectively, releasably fixing said second engagement member with respect to said first engagement member for simultaneous movement thereof.

15. An electrical assembly, comprising:

an electrical device including a housing having an inner bore with a longitudinal axis, a first engagement member received in said inner bore of said housing, said first engagement member being rotatable with respect to said housing about said longitudinal axis, and a second engagement member rotatably supported within said first engagement member; and an electrical connector including first and second ports and an inner receiving bore therebetween, with said electrical device being received in said first port.

16. An electrical assembly according to claim 15, wherein an electrical interface of a piece of electrical equipment received in said second port of said electrical connector and including a receiving bore for receiving said second engagement member of said electrical device.

17. An electrical assembly according to claim 16, wherein each of said first and second ports have first and second access openings, respectively, said first and second access openings being opposite one another.

18. An electrical assembly according to claim 15, wherein said first engagement member is axially fixed with respect to said housing; and said second engagement member of said electrical device is axially movable with respect to said first engagement member.

19. An electrical assembly according to claim 18, wherein said second engagement member slidably moves between a first position with said second engagement member spaced from said receiving bore of said electrical interface and a second position with said second engagement member engaged with said receiving bore of said electrical interface.

20. An electrical assembly according to claim 15, wherein said second engagement member of said electrical device includes external threads that engage internal threads of said receiving bore of said electrical interface.

21. An electrical assembly according to claim 20, wherein said first engagement member of said electrical device receives said second engagement member; and said first engagement member includes external threads that engage said receiving bore of said electrical connector.

22. An electrical assembly according to claim 15, wherein said first engagement member is an electrically conductive sleeve;

said second engagement member is an electrically conductive bolt; and said conductive sleeve receives said conductive bolt.

23. A method of electrically connecting an electrical device to an electrical interface of a piece of electrical equipment, comprising the steps of:

coupling the electrical device with an electrical connector by inserting the electrical device into a first port of the electrical connector and rotating a conductive first engagement member relative to an insulation housing therefor of the electrical device into an inner receiving bore of the electrical connector;

coupling the electrical connector with the electrical interface by placing the electrical interface into a second port of the electrical connector; and coupling the electrical device with the electrical interface by rotating and axially moving a conductive second engagement member supported within the first engagement member of the electrical device into a receiving bore of the electrical interface.

24. The method of electrically connecting an electrical device to an electrical interface according to claim 23, further comprising the step of simultaneously rotating the first and second engagement members of the electrical device when coupling the electrical device and the electrical connector until a shear pin extending into each of the first and second engagement members breaks to allow the second engagement member to move axially with respect to the first engagement member.

25. The method of electrically connecting an electrical device to an electrical interface according to claim 23, further comprising the steps of inserting a tool into an opening of the second engagement member of the electrical device prior to coupling the electrical device with the electrical connector; and rotating the tool to rotate the first and second engagement members until first engagement member is engaged with the inner receiving bore of the electrical connector.

26. The method of electrically connecting an electrical device to an electrical interface according to claim 25, further comprising the step of rotating the tool and the second engagement member until the second engagement member is engaged with the receiving bore of the electrical interface.

* * * * *